US007837031B2

(12) United States Patent
Counts

(10) Patent No.: US 7,837,031 B2
(45) Date of Patent: Nov. 23, 2010

(54) COIN BOOK OPERABLE TO DISPLAY RIM OF COIN

(75) Inventor: Mary C. Counts, Smyrna, GA (US)

(73) Assignee: Anderson Press, Inc., Atlanta, GA (US)

( * ) Notice: Subject to any disclaimer, the term of this patent is extended or adjusted under 35 U.S.C. 154(b) by 12 days.

(21) Appl. No.: 12/228,627

(22) Filed: Aug. 13, 2008

(65) Prior Publication Data

US 2009/0045077 A1 Feb. 19, 2009

Related U.S. Application Data

(60) Provisional application No. 60/955,776, filed on Aug. 14, 2007.

(51) Int. Cl.
*A45C 1/00* (2006.01)
*B65D 85/00* (2006.01)

(52) U.S. Cl. ..... 206/0.84; 40/661.05; 206/445

(58) Field of Classification Search ..... 206/0.8–0.84, 206/445; 229/92.9; 40/661, 661.05
See application file for complete search history.

(56) References Cited

U.S. PATENT DOCUMENTS

| | | | | | |
|---|---|---|---|---|---|
| 1,592,122 | A | * | 7/1926 | Moreland | 229/92.9 |
| 1,719,962 | A | | 7/1929 | Beistle | |
| 2,428,498 | A | * | 10/1947 | McWilliams | 206/0.83 |
| 2,860,774 | A | * | 11/1958 | Ball | 206/0.84 |
| 3,178,014 | A | | 4/1965 | Goldwasser | |
| 3,217,866 | A | | 11/1965 | Phelps | |
| 3,245,523 | A | | 4/1966 | White | |
| 3,348,763 | A | * | 10/1967 | Weston | 229/92.9 |
| 3,635,335 | A | | 1/1972 | Kramer | |
| 3,751,128 | A | | 8/1973 | Skinner et al. | |
| 3,782,537 | A | | 1/1974 | Segel | |
| 3,797,649 | A | | 3/1974 | Ringle | |
| 3,844,410 | A | | 10/1974 | Cook | |
| 4,165,573 | A | * | 8/1979 | Richards | 206/0.8 |
| 4,399,910 | A | * | 8/1983 | Gutentag | 206/0.82 |
| 4,429,787 | A | * | 2/1984 | Morse | 206/0.83 |
| 4,878,579 | A | | 11/1989 | Hager | |
| 5,011,005 | A | | 4/1991 | Boyd et al. | |
| 5,042,650 | A | | 8/1991 | Mayer et al. | |
| 5,069,347 | A | | 12/1991 | Newman | |
| 5,768,915 | A | | 6/1998 | Crumrine et al. | |
| 5,988,366 | A | | 11/1999 | Krull et al. | |
| 6,412,626 | B2 | | 7/2002 | Krull et al. | |
| 6,554,130 | B1 | | 4/2003 | Krull et al. | |
| 6,604,627 | B1 | | 8/2003 | Kennedy | |
| 6,814,227 | B2 | | 11/2004 | Seligman et al. | |
| 7,134,546 | B2 | | 11/2006 | Seligman et al. | |
| 7,322,512 | B2 | | 1/2008 | Higer | |
| 7,490,716 | B2 | | 2/2009 | Pleven | |
| 2003/0030268 | A1 | | 2/2003 | Hilicki et al. | |

(Continued)

*Primary Examiner*—Bryon P Gehman
(74) *Attorney, Agent, or Firm*—Ropes & Gray LLP

(57) ABSTRACT

A coin holder is provided that includes two covers and a flap to separate the interior surfaces of the covers. Coin containers are provided on the interior surfaces of the covers. In this manner, for example, the flap protects the surfaces of the coin containers from directly interfacing (e.g., scratching) one another. The coin containers lift a coin (or at least a portion of the rim of a coin) above the interior surface of a cover such that the rim of the coin may be viewed while the coin resides in the coin container.

14 Claims, 7 Drawing Sheets

U.S. PATENT DOCUMENTS

2004/0010953 A1* 1/2004 Chimenti et al. ..... 40/661.08
2004/0068898 A1* 4/2004 Macor ..... 40/27.5
2006/0011494 A1* 1/2006 Squadroni ..... 206/0.8
2006/0102495 A1 5/2006 McDowell et al.

* cited by examiner

500

COIN BOOK OPERABLE TO DISPLAY RIM OF COIN

CROSS-REFERENCE TO RELATED APPLICATION

This application claims the benefit of U.S. Provisional Application No. 60/955,776, filed Aug. 14, 2007, the disclosure of which is incorporated by reference herein in its entirety.

BACKGROUND OF THE INVENTION

This invention is related to coin displays.

Traditional coin displays store coins and allow for a single surface of the coin to be displayed.

SUMMARY OF THE INVENTION

A coin display is provided that allows the rim of a coin to be viewed by a user. In doing so, engravings, designs, and/or words on the rims of particular coins (e.g., Presidential Dollars) may be viewed.

The coins in a coin display may be provided in a casing that protects all surfaces of the coin. As a result, no surface of the coin is exposed directly to air.

The book may be large and may allow for a large number of coins to be displayed. Additionally, a handle may be cut out of the book (e.g., a similar aperture may be cut through all of the structures in the display that would overlap when closed). In doing so, a sturdy handle may be provided without increasing the size of the display.

The display may take the form of a book or a folder. A plurality of pages may, for example, be bound to a cover in order to form a book. Coin containers may be included on any surface of the cover (e.g., interior or exterior surface) as well as any surface of a page. Coin containers may be included on both surfaces of a structure such as both exterior and interior surface of a cover or on both sides of a page.

A coin container is provided with a coin holder that allows the rim of a coin to be viewed. Accordingly, any inscriptions, designs, etc. on the rim of a coin can be viewed while the coin is present in such coin container without having to remove the coin from the coin container.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
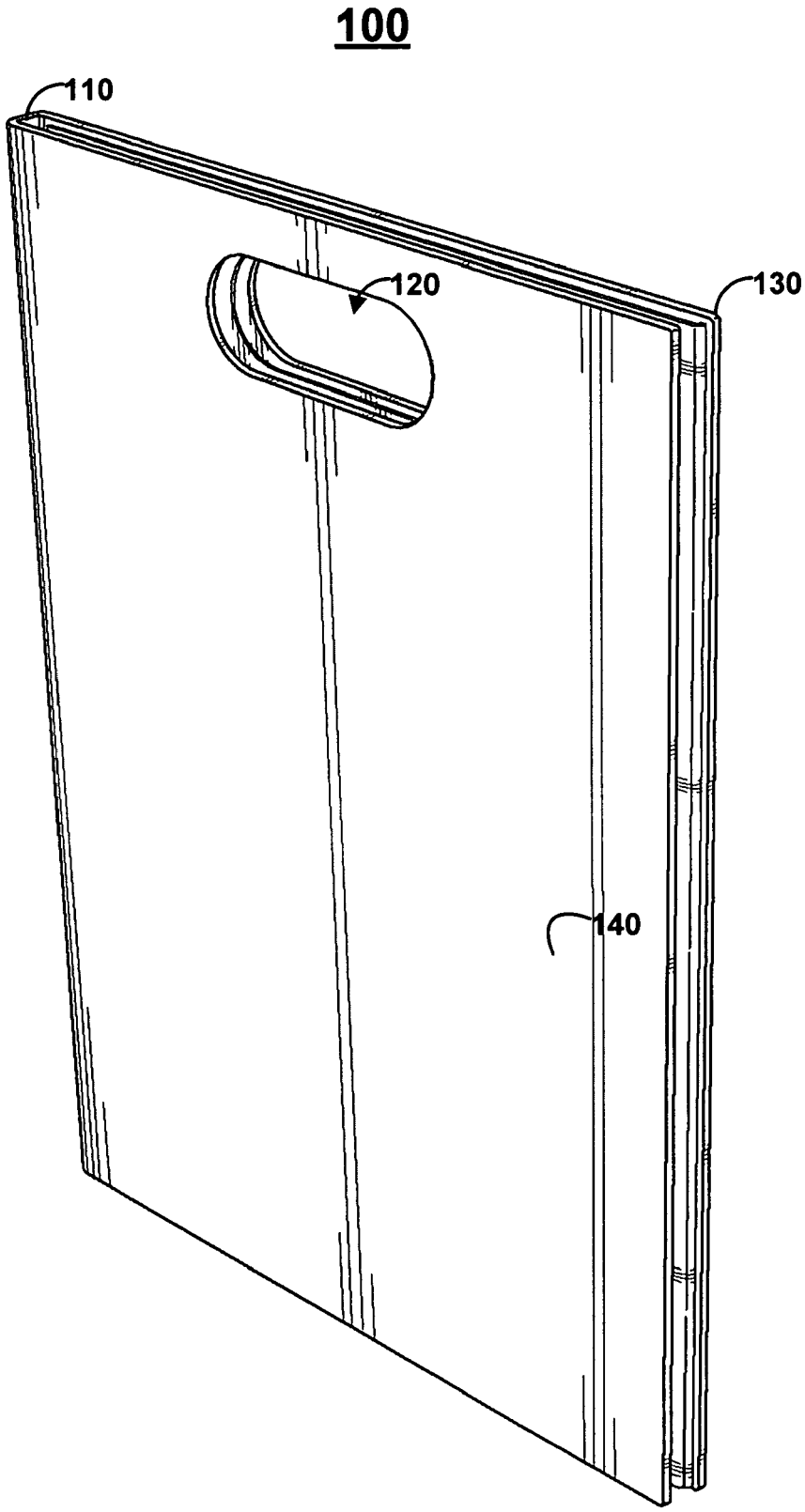
FIG. 1 is an illustration of an exterior view of a coin display constructed in accordance with the principles of the present invention.

FIG. 1 shows coin holder 100 that includes cover 140, fold 110, and cover 130. Aperture 120 may be cut-out of coin holder 100 to form a handle. Coin holder 100 may take the form of a folder or may take the form of a book. Persons skilled in the art will appreciate that the aperture of coin holder 100 may be cut-out after the holder is assembled. Alternatively, the aperture of coin holder 100 may be formed by cutting out portions of the components of coin holder 100 before coin holder 100 is fabricated. The handle may take any shape and size (e.g., a horizontally-situated rounded rectangle) and may be provided on any location of coin holder 100 (e.g., near the proximity of the top of coin holder 100). Any number of apertures (e.g., one or more) may be provided on a component of a holder, or the holder itself, to provide, for example, any number of handles (e.g., one or more).

Although coin holder 100 is illustrated as being fabricated in a rectangular shape in FIG. 1, coin holder 100 may alternatively take any shape or size in order to increase the enjoyable nature, functionality and/or educational value of coin holder 100. For example, coin holder 100 may be fabricated into a circular, triangular, trapezoidal, or star-shaped design.

Cover 140 may be fabricated from paper and/or board (e.g., cardboard) that may be coated with a polymer (e.g., a plastic) in order to add durability and water-resistance to coin holder 100. Cover 140 may include, for example, bar-code identification and price information printed on the cover to simplify selling of coin holder 100. Price information and bar code identification may be provided as removable stickers on cover 140 so that a store or end user can easily remove the information (for example, to implement a price increase). Cover 140 and/or cover 130 may be fabricated from a transparent film in order to expose interior pages 108. Additionally, text and/or illustrations may be present on coin holder 100 that may be related to a particular theme or may be descriptive information related to coin holder 100. For example, the text and/or illustrations may relate to the theme "State Coins of the United States of America." In this scenario, coins collected in coin holder 100 may also relate to the above theme.

Figure 2:
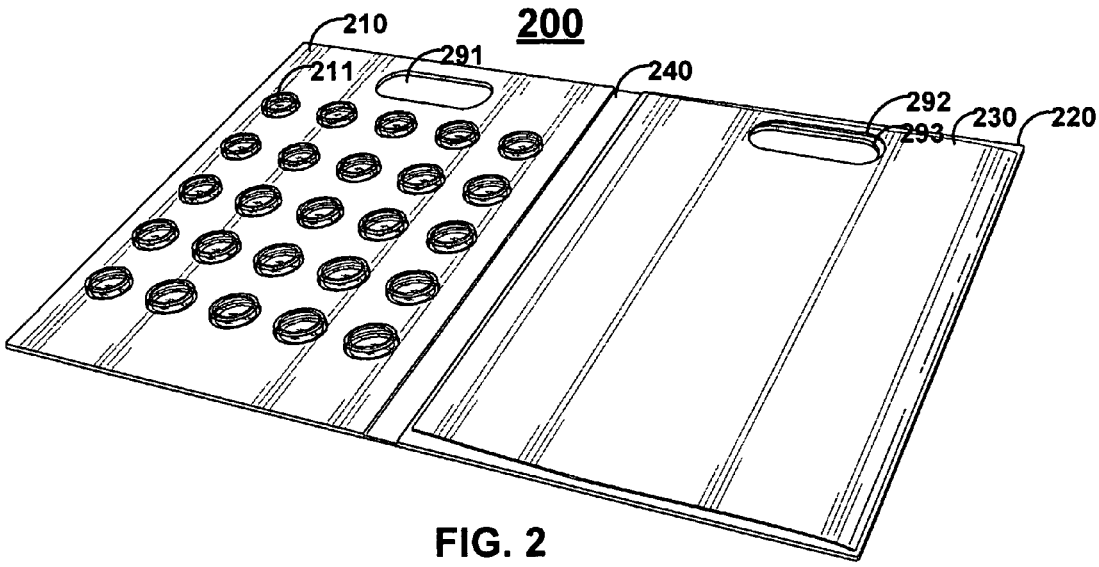
FIG. 2 is an illustration of an interior view of a coin display constructed in accordance with the principles of the present invention.

FIG. 2 shows holder 200 that includes cover 210, cover 220, and flap 230. Apertures 291, 292, and 293 may be provided such that a handle may be provided in holder 200. Covers of a coin holder may be fabricated from any material such as, for example, a cardboard, paper, or plastic. Flap 230 may take the form of a third cover. Flap 230 may also take the form of a piece of paper (e.g., a glossed piece of paper) such that flap 230 may separate and/or protect objects provided on the interior surfaces of covers 210 and 220. Covers 210 and 220 may fold about fold portion 240. Cover 210, cover 220, and fold portion 240 may be fabricated from a single sheet of material (e.g., cardboard) or from different materials. For example cover 210 may be a cardboard, cover 210 may be a cardboard, and fold portion 240 may be a paper. Coin containers (e.g., coin container 211) may be provided such that coins may be stored in holder 200. Such containers may be fabricated from a transparent material such as a transparent polymer (e.g., a transparent plastic). Coin container 211 may be adhered to a cover by an adhesive (e.g., glue) or may be removable from the cover. Coin container 211 may be configured such that a coin sits in coin container 211 above the surface of cover 210. In doing so, the rim of a coin may be visible to a user while the coin is stored in coin holder 100. Persons skilled in the art will appreciate that a coin container may be formed from a disk such that the surface of a cover forms the bottom of an area that is sized to retain a coin. A container cover may be provided that interacts with such a disc (or any container).

A number of coin containers similar to coin container 211 may be provided in holder 200. The number of coin containers may be based on the number of coins in a commemorative set. For example, the number of coin containers may be based on the number of U.S. presidents or the number of states in the union (e.g., 50) such that holder 200 can receive a complete collection of state or presidential coins. Furthermore, not all coin containers provided in holder 200 are required to be exactly the same size and shape. For example, some coin holders may be larger or smaller than one another, some coin holders may be circular in shape while some coin holders may be oval in shape, etc.

Figure 3:
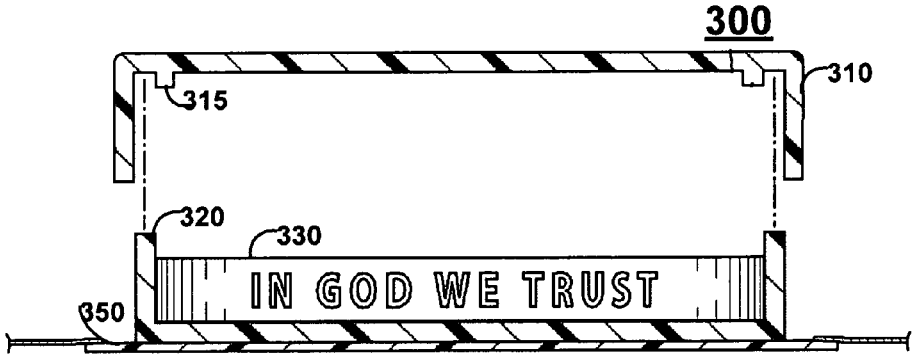
FIG. 3 is an illustration of a coin display container constructed in accordance with the principles of the present invention.

FIG. 3 shows coin container 300 that includes primary housing 350 and secondary housing 310. Ridge 315 may be provided (e.g., to form a circular ridge on secondary housing 310) such that the top surface of coin 330 is spaced away from the interior surface of secondary housing 310. End portion 320 may also be sized and shaped to fit between ridge 315 and the side of secondary housing 310 such that housings 350 and 310 securely fit together. One or more ridges may be provided underneath coin 330 to lift a coin up above the nearby surface of primary housing 350. A ridge may, for example, be provided as one or more separated protruding structures.

Figure 4:
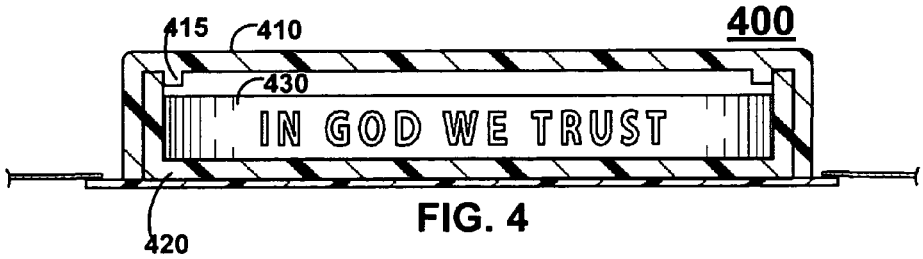
FIG. 4 is an illustration of a coin display container constructed in accordance with the principles of the present invention.

FIG. 4 shows primary housing 420, secondary housing 410, and ridge 415. Ridge 415 may be sized such that ridge 415 does not touch the surface of a coin (e.g., coin 430) resting against primary housing 420. Alternatively, ridge 415 may be sized to touch the surface of a coin resting against primary housing 420. A primary housing may be adhered (e.g., glued) to a first layer of a cover and then a second layer of a cover may be laid over the primary housing. An aperture may be cut in this second layer such that a portion of the primary housing is sandwiched between the two layers, but that at least the coin-receivable aperture of the primary housing is accessible to a user.

Figure 5:
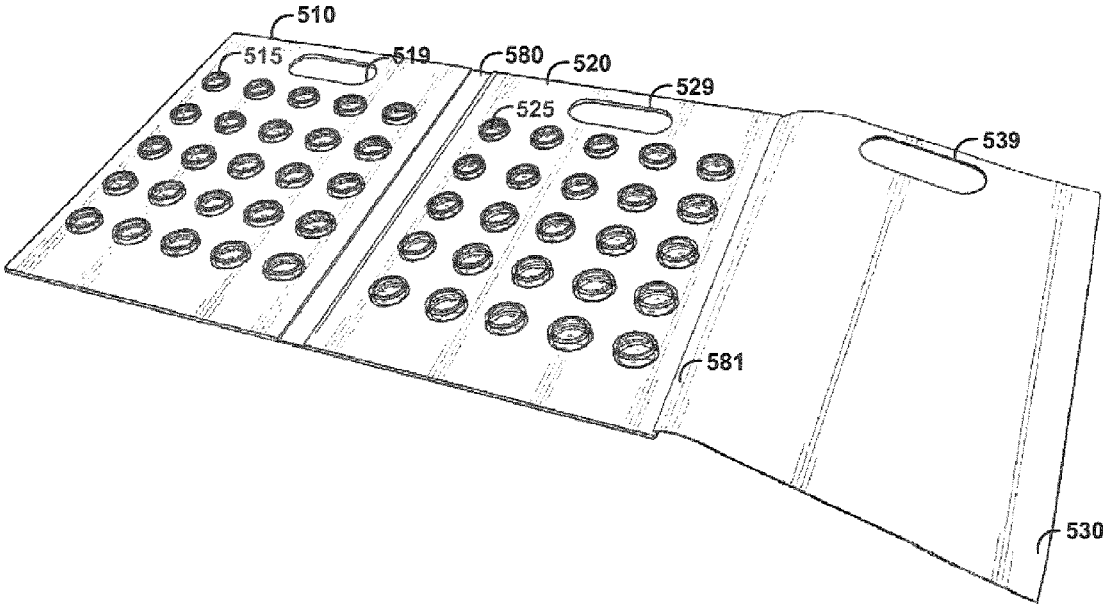
FIG. 5 is an illustration of a coin display constructed in accordance with the principles of the present invention.

FIG. 5 shows holder 500 that includes cover 510, cover 520, flap 530, fold portion 580, and connection portion 581. An edge of flap 530 may be adhered (e.g., glued) in the proximity of an edge of cover 520. Apertures 519, 529, and 539 may be provided to form a handle when holder 500 is closed. Coin containers (e.g., coin containers 515 and 525) may be provided on the interior surfaces of cover 510 and 520. Additionally, coin containers may be provided on the exterior surfaces of covers 510 and 520 as well as either, or both, of flap 530. Persons skilled in the art will appreciate that coin containers do not have to be provided on the interior surface of either cover 510 or 520. For example, coin containers may be provided on the exterior surface of cover 510 and 520.

Additionally, text and/or illustrations may be present on one or both surfaces of cover 510, cover 520, and/or flap 530. The text and illustrations may be related to a particular theme or may be descriptive information related to holder 500. For example, the text and/or illustrations may relate to the theme "State Coins of the United States of America." In this scenario, coins collected in holder 500 may also relate to the above theme.

Figure 6:
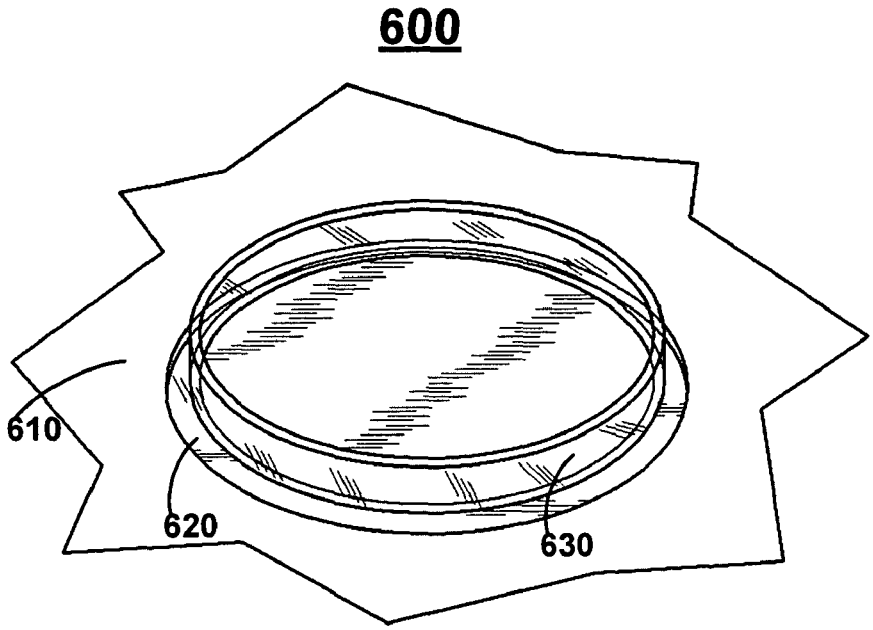
FIG. 6 is an illustration of a coin display structure constructed in accordance with the principles of the present invention.

FIG. 6 shows coin holder 600 that may comprise cover layer 610, primary housing portion 620 (e.g., a coin receivable portion), and secondary housing 630 (e.g., a cover). In some embodiments, primary housing portion 620 may be adhered (e.g., glued) to cover layer 610. In some embodiments, primary housing portion 620 may be removable from cover layer 610.

Secondary housing 630 may be placed on top of or over primary housing portion 620. In some embodiments, secondary housing 630 may be adhered to primary housing portion 620. For example, primary housing portion 630 may be permanently adhered to primary housing portion 620 in order to protect a coin and/or prevent the coin's removal from within primary housing portions 620 and secondary housing 630. Alternatively, in some embodiments, secondary housing 630 may be readily removable from primary housing portion 620 in order to allow a coin to be removed from coin holder 600.

Figure 7:
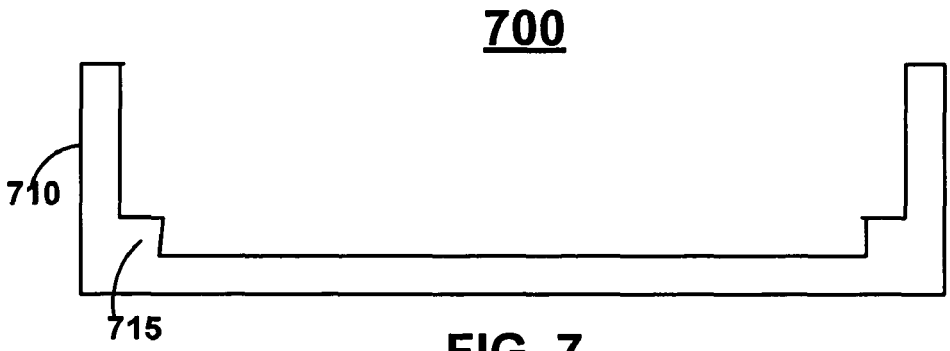
FIG. 7 is an illustration of a coin display structure constructed in accordance with the principles of the present invention.

FIG. 7 shows primary housing portion 700 that includes side 710 and step portion 715. Step portion 715 of primary housing portion 700 may provide an elevated surface for a coin placed therein to rest. Such an elevated resting surface may make it possible to see the entire rim of the coin placed in primary housing portion 700.

Figure 8:
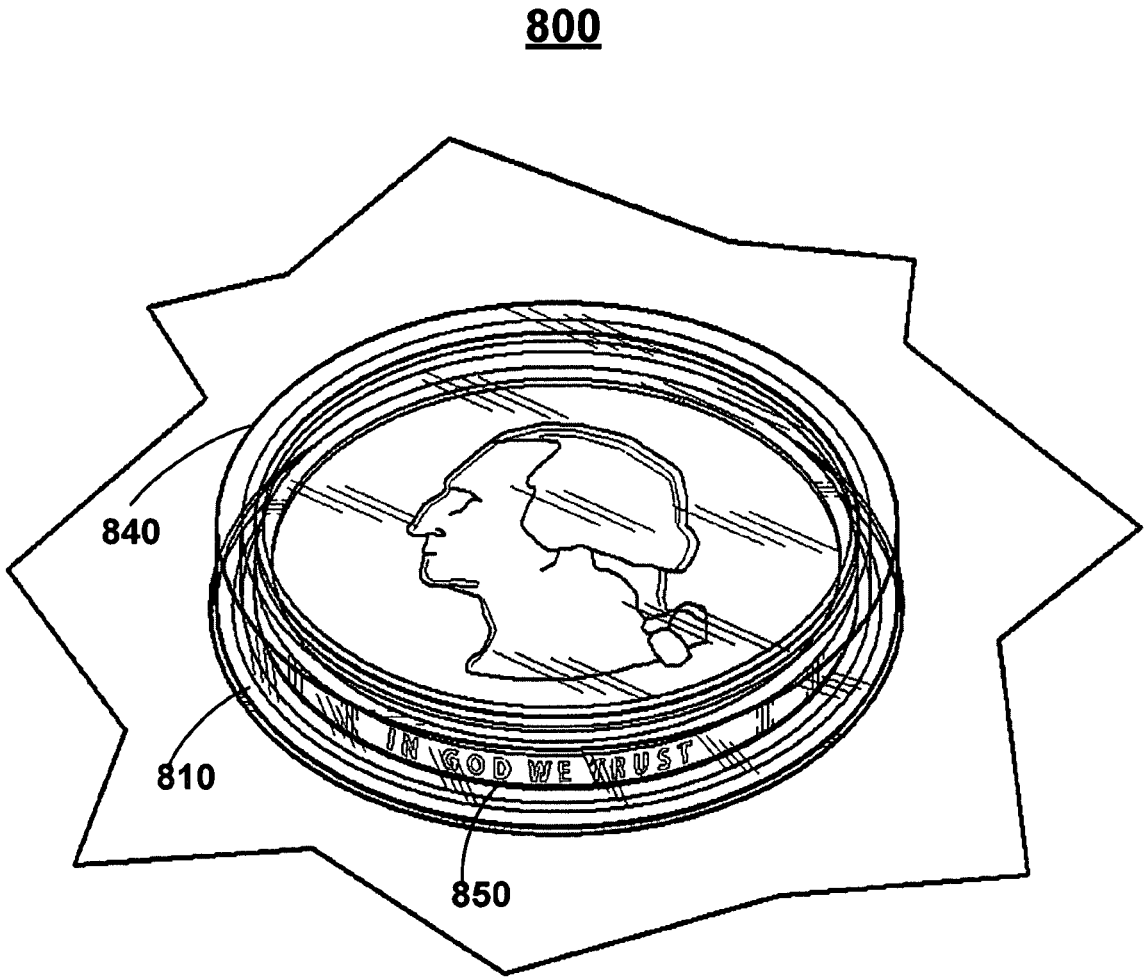
FIG. 8 is an illustration of a coin display container constructed in accordance with the principles of the present invention.

FIG. 8 shows holder 800 that may comprise secondary housing 840 (e.g., a cover), primary housing portion 850 (e.g., a coin-receivable portion), and primary housing portion 810 (e.g., a cover securing portion). When a coin is provided in holder 800, a user may see the rim of the coin. For example, a user may be able to see writing (e.g., "In God We Trust") that is present on the rim of the coin.

Figure 9:
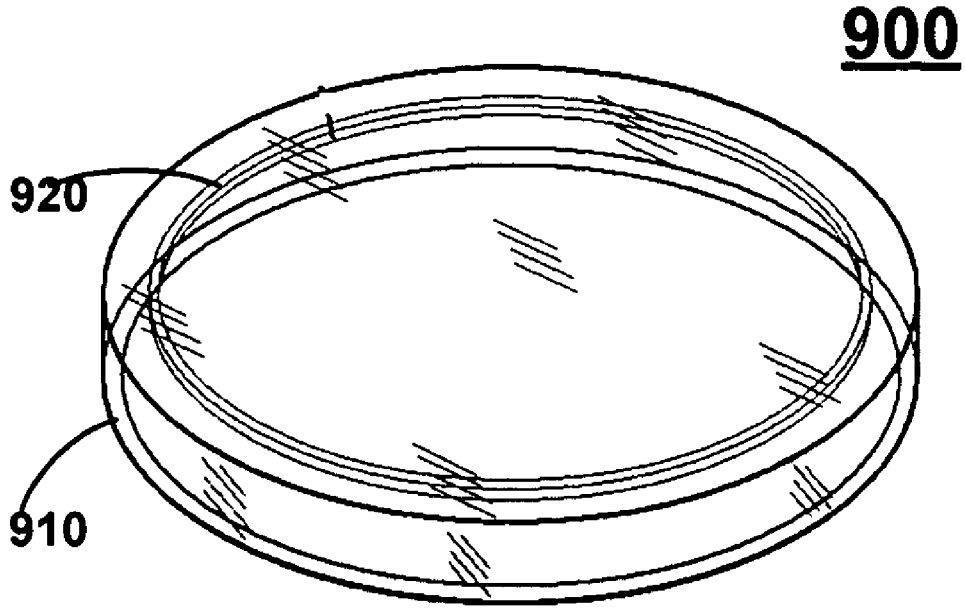
FIG. 9 is an illustration of a coin display container constructed in accordance with the principles of the present invention.

FIG. 9 shows container 900 that includes ridge 920 on secondary housing 910 (e.g., a cover portion). Ridge 920 may be provided such that the top surface of a coin provided in container 900 is spaced away from the interior surface of secondary housing 910. Ridge 920 may be sized such that ridge 920 does not touch the surface of a coin resting in holder 900. Alternatively, ridge 920 may be sized to touch the surface of a coin resting in holder 900.

Figure 10:
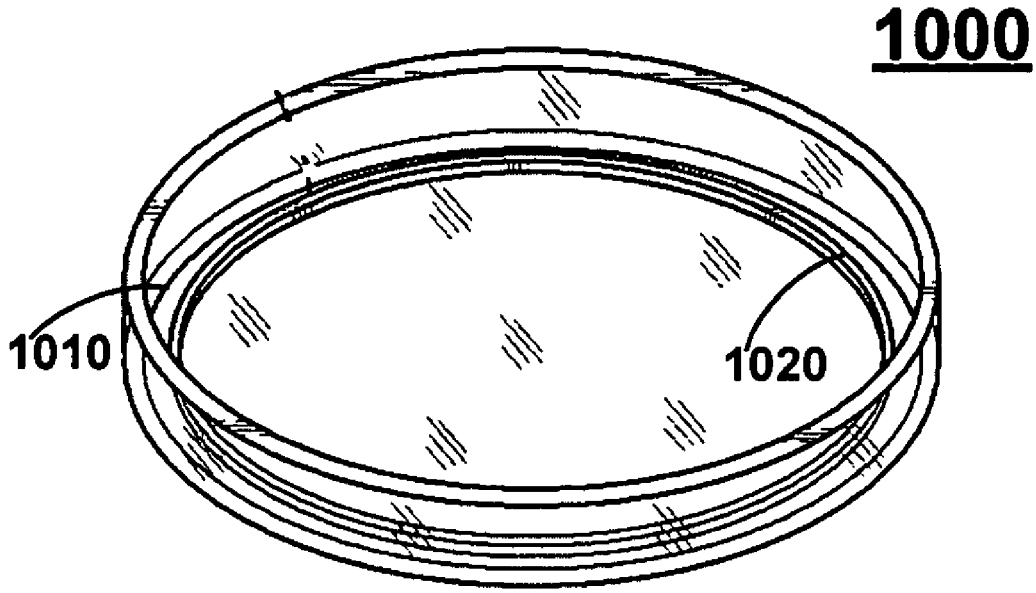
FIG. 10 is an illustration of a coin display container constructed in accordance with the principles of the present invention.

FIG. 10 shows container 1000 that includes step 1020 spaced from the side of primary housing portion 1010 (e.g., a coin-receivable portion). Step 1020 may provide an elevated surface for a coin placed therein to rest. Such an elevated resting surface may make it possible to see the entire rim of a coin placed in primary housing portion 1010. Additionally, step 1020 may keep at least a portion of the surface of a coin in container 1000 from touching primary housing portion 1010.

Figure 11:
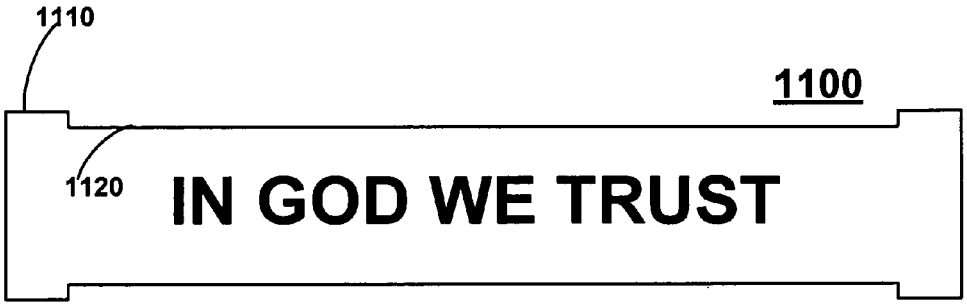
FIG. 11 is an illustration of an example coin in accordance with some embodiments of the present invention.

FIG. 11 shows a coin having an extended portion 1110 and an unextended portion 1120. Persons skilled in the art will appreciate that ridges may be spaced so that ridges interact with the size of extending portion 1110 (or lie adjacent to, and in the proximity of, extension portion 1110). Such ridges may be provided on one or both sides of a container (e.g., the coin-receivable portion and the cover portion). Steps may similarly be provided to abut the top or bottom surface of extended portion 1110 (e.g., step portion 715 of FIG. 7).

Figure 12:
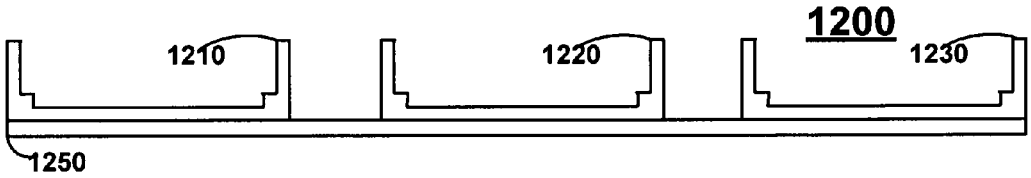
FIG. 12 is an illustration of a coin display structure constructed in accordance with the principles of the present invention.

FIG. 12 shows container structure 1200 that includes primary housing portions 1210, 1220, and 1230 having a common housing portion 1250. Persons skilled in the art will appreciate that container structure 1200 may be formed from a single piece of material (e.g., formed into a single piece of plastic). Accordingly structure 1200 may be adhered (e.g., glued) to a cover of a holder or may form a cover itself. Similarly, primary housing portion 1210 may be adhered (e.g., glued or taped) to portion 1250. A container, similar to portion 1210, may be adhered (e.g., glued or taped) to a cover. Objects other than coins may be stored in a container. For example, a container may be sized to receive a marble such that the side of a marble may be viewed in a container.

From the foregoing description, persons skilled in the art will recognize that this invention provides a protection device for coins. In addition, persons skilled in the art will appreciate that the various configurations described herein may be combined without departing from the present invention. It will also be recognized that the invention may take many forms other than those disclosed in this specification. Accordingly, it is emphasized that the invention is not limited to the disclosed methods, systems and apparatuses, but is intended to include variations to and modifications thereof which are within the spirit of the following claims.

What is claimed is:

1. A holder comprising:

a first cover, wherein the first cover comprises a first surface; and a first coin container provided on the first surface and configured to receive a first coin, the first coin container comprising:

a primary housing coupled to the first surface, the primary housing comprising a first step portion along a periphery therein configured to lift a received first coin above the first surface wherein at least a portion of the rim of the received first coin is viewable through the first coin container; and a secondary housing coupled to the primary housing and configured to cover at least a portion of the primary housing.

2. The holder of claim 1, wherein the first surface is the interior surface of the first cover.

3. The holder of claim 1, wherein the first surface is the exterior surface of the first cover.

4. The holder of claim 1, further comprising:

a second cover, wherein the second cover comprises a second surface and is coupled to the first cover via a fold portion; and a second coin container provided on the second surface and configured to receive a second coin, wherein at least a portion of the rim of the second coin is viewable through a received second coin is.

5. The holder of claim 4, further comprising:

a flap coupled to the second cover, wherein the flap separates the first cover and the second cover when the holder is closed.

6. The holder of claim 1, wherein a plurality of coin containers are provided on the first surface.

7. The holder of claim 1, wherein the primary housing of the first coin container is removably coupled to the first surface.

8. The holder of claim 1, wherein the secondary housing is permanently coupled to the primary housing, and wherein the received first coin is not removable from the first coin container.

9. The holder of claim 1, wherein the secondary housing is removably coupled to the primary housing, and wherein the received first coin is removable from the first coin container.

10. The holder of claim 1, wherein the secondary housing comprises a ridge, and wherein the ridge is positioned such that the interior surface of the secondary housing is not in contact with the received first coin.

11. The holder of claim 10 wherein the primary housing further comprises an end portion shaped to fit between the ridge and the side of the secondary housing to securely couple the primary housing to the secondary housing structure.

12. The holder of claim 10 wherein the ridge does not contact the upper surface of the received first coin.

13. The holder of claim 10 wherein the ridge contacts the upper surface of the received first coin.

14. The holder of claim 1, further comprising a theme related to the holder, and wherein an image is printed on the holder that relates to the theme.

* * * * *